United States Patent [19]

Peeters

[11] Patent Number: 4,923,744

[45] Date of Patent: May 8, 1990

[54] PRESENTATION BASKET

[76] Inventor: Emma L. Peeters, 3832 Larkspur Dr., Concord, Calif. 94519

[21] Appl. No.: 295,136

[22] Filed: Jan. 9, 1989

[51] Int. Cl.[5] ..... B65D 5/46; B65D 5/48

[52] U.S. Cl. ..... 428/34.1; 206/44 K; 206/45.14; 206/141; 229/120.33; 229/914; 428/36.1; 428/100

[58] Field of Search ..... 229/120.33, 120.36, 229/914; 206/44 K, 141, 45.14, 561; 428/100, 34.1, 36.1

[56] References Cited

U.S. PATENT DOCUMENTS

| | | | |
|---|---|---|---|
| D. 52,744 | 12/1918 | Holstein . | |
| D. 234,221 | 1/1975 | Lipchurch | D26/62 |
| D. 247,356 | 2/1978 | Wright | D11/144 |
| D. 253,382 | 11/1979 | Spruiel | D6/513 |
| 2,007,644 | 7/1935 | Frank | 229/120.33 |
| 2,233,813 | 3/1941 | Grossman | 206/44 K |
| 2,580,333 | 12/1951 | Thomas | 229/120.36 |
| 2,838,221 | 6/1958 | Wilson | 229/914 |
| 3,157,558 | 11/1964 | Adler | 428/18 |
| 3,494,498 | 2/1970 | Atherton | 229/120.36 |
| 4,693,921 | 9/1987 | Billarant et al. | 428/100 |
| 4,726,975 | 2/1988 | Hatch | 428/100 |

*Primary Examiner*—James Seidleck
*Attorney, Agent, or Firm*—Leon Gilden

[57] ABSTRACT

A presentation basket device is set forth for enabling the basket to accommodate a variety of specialized festive occasions. The basket comprises a woven container portion with an overlying handle of conventional construction with a separable partition selectively securable in a variety of orientations to effect compartmental size changes, as desired. An outer fringe is securable to a projecting rib integrally secured to the basket by an underlying "L" shaped series of brackets to enable securement about the rib of various fringes indicative of the various festive occasions for which the basket is intended.

7 Claims, 1 Drawing Sheet

PRESENTATION BASKET

BACKGROUND OF THE INVENTION

1. Field of the Invention

The field of invention relates to baskets, and more particularly pertains to a new and improved presentation basket wherein the same may be modified as desired to accommodate various festive occasions.

2. Description of the Prior Art

The use of baskets for transport and presentation of various items therewithin is well known in the prior art. Baskets of the prior art have been typically of predetermined configuration not accommodating variation within the basket of various geometrically desired compartments. For example, U.S. design patent 284,221 to Upchurch, U.S. design patent 52,744 to Holstein, U.S. design patent 253,882 to Spruiel, and U.S. design patent 247,356 to Wright set forth various baskets and the like for securement of ornamental displays therewithin. By contrast, the instant invention sets forth a basket whose interior compartments may be modified as desired to accommodate various compartmental changes of varying configurations to enable positionment of various sized objects therewith. Further, instruction booklet and slot are provided within an elongate wall of the separable partition providing a user an instructional basis for arranging various items therewithin U.S. Pat. No. 3,157,558 to Adler sets forth a foliage display organization wherein removable limbs of an associated artificial trunk structure accommodates a varying display for effecting a natural appearance of the associated organization.

As such, it may be appreciated that there is a continuing need for a new and improved presentation basket wherein the same overcomes the problems of versatility and effectiveness in use, and in this respect, the present invention substantially fulfills this need.

SUMMARY OF THE INVENTION

In view of the foregoing disadvantages inherent in the known types of presentation baskets now present in the prior art, the present inventIon provides a presentation basket wherein the same sets forth a versatile structure to accommodate various presentation displays for commemorative and festive occasions. As such, the general purpose of the present invention, which will be described subsequently in greater detail, is to provide a new and improved presentation basket which has all the advantages of the prior art presentation baskets and none of the disadvantages.

To attain this, the present invention comprises a basket structure with an overlying handle wherein a separable partition comprises an elongate partition member selectively securable to a plurality of orthogonally oriented partition members by hook and loop fasteners. Fabric loop lining is positioned within the basket to anchor hook fabric fasteners on the partition members to the interior of the basket wall. Further, a rib extending outwardly of the basket exterior surface is secured relative to the surface by a series of downwardly depending "L" shaped brackets wherein a fringe is securably mounted between the rib and the basket by piercing fasteners to selectively secure various trim arrangements to the basket and accommodate the basket to various occasions.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved presentation basket which has all the advantages of the prior art presentation baskets and none of the disadvantages.

It is another object of the present invention to provide a new and improved presentation basket which may be easily and efficiently manufactured and marketed.

It is a further object of the present invention to provide a new and improved presentation basket which is of a durable and reliable construction.

An even further object of the present invention is to provide a new and improved presentation basket which is susceptible of a low cost of manufacture with regard to both materials and labor, and which accordingly is then susceptible of low prices of sale to the consuming public, thereby making such presentation baskets economically available to the buying public.

Still yet another object of the present invention is to provide a new and improved presentation basket which provides in the apparatuses and methods of the prior art some of the advantages thereof, while simultaneously overcoming some of the disadvantages normally associated therewith.

Still another object of the present invention is to provide a new and improved presentation basket wherein the same sets forth a geometrically manipulatable interior to accommodate various displays therewithin and further provides for selective securement of a perimeter fringe material of varying character.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
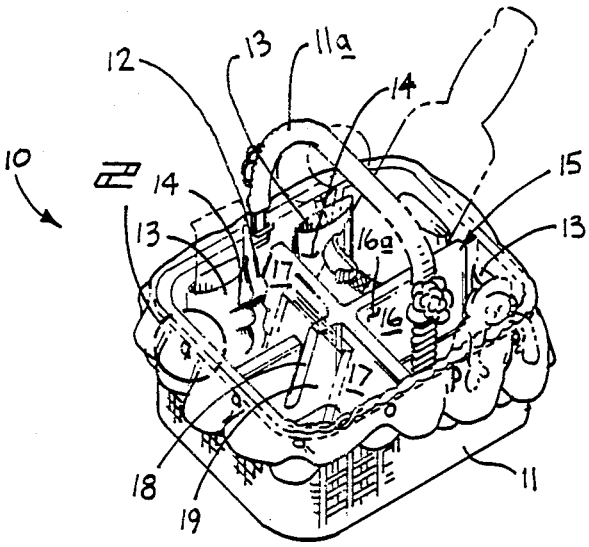
FIG. 1 is an isometric illustration of the instant invention.

With reference now to the drawings, and in particular to FIGS. 1 to 4 thereof, a new and improved presentation basket embodying the principles and concepts of the present invention and generally designated by the reference numeral 10 will be described.

More specifically, it will be noted that the presentation basket 10 essentially comprises a woven basket container body 11 formed with an integrally upwardly depending handle 11*a*. The container body 11 is lined with a fabric loop interior 12. A plurality of pockets 13 are secured proximate their open ends and are formed with a medially positioned accordion pleat to extend and contract the pocket 13, as is deemed appropriate, for securement of various contents therewithin.

Figure 4:
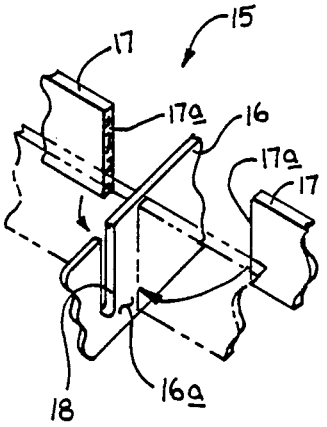
FIG. 4 is an isometric illustration of the partition assembly of the instant invention, somewhat expanded for illustrative purposes.
Figure 2:
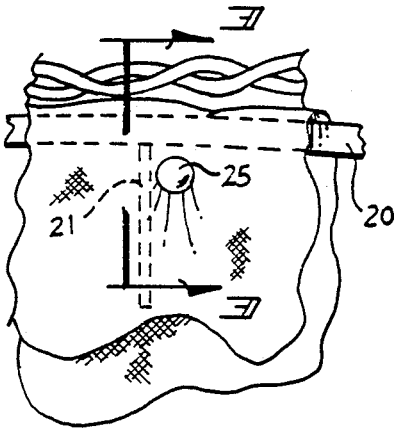
FIG. 2 is an orthographic view of section 2 of FIG. 1, somewhat expanded for illustrative purposes.
Figure 3:
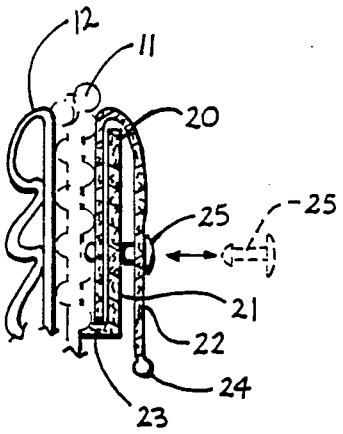
FIG. 3 is an orthographic view taken along the lines 3—3 of FIG. 2 in the direction indicated by the arrows.

A partition assembly 15, as illustrated in FIG. 4, is formed with an elongate first partition member 16 formed with fabric loop surfaces 16*a* for selective securement to fabric hook surfaces 17*a* of a plurality of orthogonally securable second partition members 17. Accordingly, the second partition members 17 are secured at either of their ends to the first partition member 16 to provide variously configured compartments within the basket 11. The opposite ends opposed to those secured by the first ends of the second partition members 17 are secured to the fabric loop interior 12 of the basket 11 to provide a secure and stable partition assemblage. A slot 18 diagonally formed orthogonally from an upper surface of the first partition member 16 downwardly secures an associated book 19. The book 19 provides instruction and guidance for forming presentation baskets 10 appropriate for various occasions.

Formed proximate an upper terminal edge of the basket 11 and extending outwardly therefrom is an encircling rib 20. The encircling rib 20 is secured to the exterior surface of the basket 11 by a series of downwardly depending "L" brackets 21 secured at one end of a first elongate leg to a lower surface of the rib 20 and wherein the "L" brackets 21 are secured by a shorter second leg to the exterior surface of the basket 11. Accordingly, a flexible fringe 22 of various configurations may therefore be selectively secured adjacent and about the upper terminal edge of the basket 11 by positioning a first end of the fringe 22 overlying the rib 20 and extending downwardly to the lower second leg of the "L" brackets 21 wherein a second end 24 of the fringe 22 extends downwardly below the second leg of the "L" brackets 21. The confronting surfaces of the fringe 22 are thereby secured together by a series of self-piercing fasteners 25 directed through the plural layers of the fringe 22 when draped over the rib 20.

In this manner, the presentation basket 10 may be utilized repeatedly and provide basis for securement of various items representative of various ceremonial and festive occasions.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A presentation basket comprising, a basket container body including an exterior surface and an interior surface and further including an integral upwardly depending handle overlying a cavity defined by said interior surface, and a partition assembly removably securable within said cavity including fastening means on portions of said partition assembly for securement of said assembly to said interior surface of said cavity, and wherein said interior surface of said cavity is covered by a fabric loop portion, and wherein said fastening means includes hook fabric fasteners securable and interengageable with said fabric loop portion.

2. A presentation basket as set forth in claim 1, wherein said partition assembly includes an elongate first partition member and a plurality of second partition members securable orthogonally to opposite side surfaces of said first partition member.

3. A presentation basket as set forth in claim 2, wherein said side surfaces of said first partition member are covered with further fabric loop portions interengageable with fabric hook portions formed on opposite ends of said second partition members to define said fastening means.

4. A presentation basket as set forth in claim 3, further including an encircling rib spaced outwardly proximate an upper terminal edge of said container body.

5. A presentation basket as set forth in claim 4, wherein said encircling rib includes a plurality of downwardly depending "L" shaped brackets wherein a first leg of each of said brackets is securable to an underlying surface of said rib with a second shorter leg of said bracket secured integrally and orthogonally to said exterior surface of said container body.

6. A presentation basket as set forth in claim 5, further including a flexible fringe draped over said rib with a first end of said fringe extending downwardly a distance approximately equal to that of said "L" shaped bracket with a second end of said fringe extending downwardly past each of said "L" shaped brackets.

7. A presentation basket a set forth in claim 6, further including a plurality of self-piercing fasteners securable through the flexible fringe and securing said fringe to said encircling rib.

* * * * *